US010316574B2

(12) United States Patent
Lubotta

(10) Patent No.: US 10,316,574 B2
(45) **Date of Patent: *Jun. 11, 2019**

(54) STORAGE ASSEMBLY HAVING USER-ACCESSIBLE COMPARTMENTS CATEGORIZED BY DIFFERENT LEVELS OF USER ACCESS

(71) Applicant: COOLSAFE ENTERPRISES INC., Toronto (CA)

(72) Inventor: David Lubotta, Toronto (CA)

(73) Assignee: COOLSAFE ENTERPRISES INC., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/047,459

(22) Filed: Jul. 27, 2018

(65) Prior Publication Data

US 2018/0334847 A1 Nov. 22, 2018

Related U.S. Application Data

(63) Continuation of application No. 15/661,274, filed on Jul. 27, 2017, which is a continuation of application No. 13/844,709, filed on Mar. 15, 2013, now Pat. No. 9,732,550.

(60) Provisional application No. 61/681,812, filed on Aug. 10, 2010.

(51) Int. Cl.

| | |
|---|---|
| ***F25D 3/08*** | (2006.01) |
| ***E05G 1/08*** | (2006.01) |
| *E05G 1/10* | (2006.01) |
| *E05G 1/00* | (2006.01) |

(52) U.S. Cl.

CPC ..... *E05G 1/08* (2013.01); *F25D 3/08* (2013.01); *E05G 1/005* (2013.01); *E05G 1/10* (2013.01)

(58) Field of Classification Search

CPC ..... F25D 3/08; F25D 2331/804; F25D 2303/081; E05G 1/08; E05G 1/005

USPC ..... 312/237; 220/592.03; 62/457.7, 457.1

See application file for complete search history.

(56) References Cited

U.S. PATENT DOCUMENTS

| | | | |
|---|---|---|---|
| 1,123,227 | A | 1/1915 | Bodker et al. |
| 3,710,736 | A | 1/1973 | Biondi et al. |
| 4,164,907 | A | 8/1979 | Piatscheck et al. |
| 4,232,613 | A | 11/1980 | Kempf |
| 4,667,484 | A | 5/1987 | Tarozzi et al. |
| 4,669,394 | A | 6/1987 | Fogleman et al. |
| 4,832,163 | A | 5/1989 | Levesque |

(Continued)

FOREIGN PATENT DOCUMENTS

| | | | |
|---|---|---|---|
| AU | 2003252915 | A1 | 5/2004 |
| CN | 201386421 | Y | 1/2010 |

(Continued)

OTHER PUBLICATIONS

Document relating to European Application No. 13828444.3, dated Jun. 3, 2016 (Extended European Search Report). pp. 1-17.

(Continued)

*Primary Examiner* — Matthew W Ing

(74) *Attorney, Agent, or Firm* — Bereskin & Parr LLP/S.E.N.C.R.L.,s.r.l.

(57) ABSTRACT

In accordance with an aspect, there is provided a furniture apparatus comprising an outdoor-storage assembly having user-accessible compartments being arranged relative to each other, of which are categorized by different types of user access.

20 Claims, 11 Drawing Sheets

(56) References Cited

U.S. PATENT DOCUMENTS

| | | | | |
|---|---|---|---|---|
| 4,924,893 | A | 5/1990 | Furey | |
| D308,744 | S | 6/1990 | Arauchi | |
| 5,100,198 | A | 3/1992 | Baltzell | |
| 5,106,141 | A | 4/1992 | Mostashari | |
| 5,143,108 | A * | 9/1992 | Kenney | A45B 3/00 108/151 |
| 5,199,361 | A | 4/1993 | Robinson | |
| 5,435,642 | A | 7/1995 | Kennedy | |
| 5,558,027 | A | 9/1996 | Williams et al. | |
| 6,082,157 | A | 7/2000 | Boyce et al. | |
| 6,216,488 | B1 | 4/2001 | Rucker | |
| 6,323,782 | B1 * | 11/2001 | Stephens | G07C 9/00103 340/10.31 |
| 6,422,030 | B1 | 7/2002 | Calvert | |
| 6,487,977 | B1 | 12/2002 | Williams et al. | |
| 6,533,298 | B2 | 3/2003 | Sims | |
| 6,554,012 | B2 | 4/2003 | Patarra | |
| 6,796,319 | B1 | 9/2004 | Patarra et al. | |
| D498,895 | S | 11/2004 | Lynch et al. | |
| 6,814,383 | B2 | 11/2004 | Reed, III et al. | |
| 6,964,179 | B2 | 11/2005 | Yoshida | |
| 6,988,078 | B1 | 1/2006 | Heidenreich et al. | |
| D534,965 | S | 1/2007 | Chung | |
| 7,161,483 | B2 | 1/2007 | Chung | |
| 7,249,799 | B2 | 7/2007 | Luce | |
| D557,875 | S | 12/2007 | Stuhlbarg et al. | |
| 7,350,470 | B1 | 4/2008 | Stuhlbarg et al. | |
| D574,125 | S | 7/2008 | Gunst et al. | |
| 7,401,482 | B1 | 7/2008 | Shaw et al. | |
| 7,486,188 | B2 | 2/2009 | Van Alstyne | |
| 7,537,015 | B1 | 5/2009 | Molnar, IV et al. | |
| 7,604,290 | B1 | 10/2009 | Giordano | |
| 7,696,871 | B2 | 4/2010 | Villiger | |
| D617,525 | S | 6/2010 | Taylor et al. | |
| D617,974 | S | 6/2010 | Alfeld, Sr. | |
| D620,675 | S | 7/2010 | Doettling | |
| 7,784,689 | B2 | 8/2010 | Linton et al. | |
| D624,275 | S | 9/2010 | Min | |
| 7,908,977 | B2 | 3/2011 | Zak et al. | |
| 8,162,330 | B2 | 4/2012 | Melkumyan et al. | |
| 8,256,156 | B1 | 9/2012 | Burgoyne, Jr. | |
| 8,264,329 | B2 | 9/2012 | Roberts et al. | |
| D671,705 | S | 11/2012 | Edmondson | |
| 9,732,550 | B2 * | 8/2017 | Lubotta | E05G 1/08 |
| 2005/0204787 | A1 | 9/2005 | Ernst et al. | |
| 2006/0101877 | A1 | 5/2006 | Orum et al. | |
| 2006/0124157 | A1 * | 6/2006 | Bayour | A45B 3/10 135/16 |
| 2008/0031483 | A1 | 2/2008 | Hill | |
| 2009/0046609 | A1 * | 2/2009 | Mahany | G06F 1/163 370/310 |
| 2009/0078702 | A1 | 3/2009 | Martin, Jr. et al. | |
| 2009/0084778 | A1 | 4/2009 | Smario | |
| 2009/0088077 | A1 | 4/2009 | Brown et al. | |
| 2009/0101046 | A1 | 4/2009 | Zak et al. | |
| 2009/0254439 | A1 | 10/2009 | Dunn | |
| 2010/0051137 | A1 | 3/2010 | Layton | |
| 2010/0275642 | A1 | 11/2010 | Klettner | |
| 2011/0001407 | A1 * | 1/2011 | Stradiota | E05B 65/0075 312/237 |
| 2011/0145073 | A1 | 6/2011 | Richman et al. | |
| 2011/0187530 | A1 | 8/2011 | Sterzinger et al. | |
| 2011/0226003 | A1 | 9/2011 | Chaney et al. | |
| 2011/0265694 | A1 | 11/2011 | Portis et al. | |
| 2012/0122584 | A1 | 5/2012 | Nguyen | |
| 2012/0222589 | A1 | 9/2012 | Miyashita | |
| 2012/0298018 | A1 | 11/2012 | McCabe | |
| 2013/0020874 | A1 | 1/2013 | Ayotte et al. | |
| 2013/0082822 | A1 | 4/2013 | Levenick et al. | |
| 2013/0339163 | A1 | 12/2013 | Dumontet et al. | |
| 2014/0041558 | A1 | 2/2014 | Lubotta | |
| 2014/0366784 | A1 | 12/2014 | Berger | |

FOREIGN PATENT DOCUMENTS

| | | | |
|---|---|---|---|
| CN | 201412019 | Y | 2/2010 |
| CN | 202262651 | U | 6/2012 |
| EP | 1161909 | A2 | 12/2001 |
| GB | 2432185 | A | 5/2007 |
| GB | 2469827 | A | 11/2010 |
| WO | 0125579 | A1 | 4/2001 |

OTHER PUBLICATIONS

International Search Report and Written Opinion for International Patent Application No. PCT/CA2012/050888 dated Feb. 26, 2013, pp. 1-8.

* cited by examiner

FIG. 6E
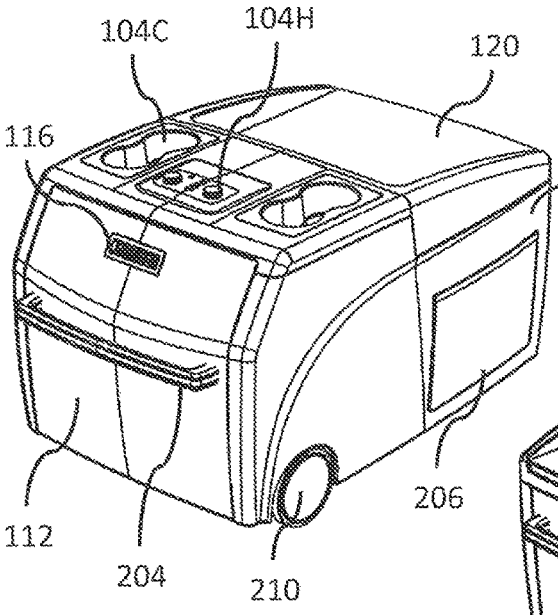
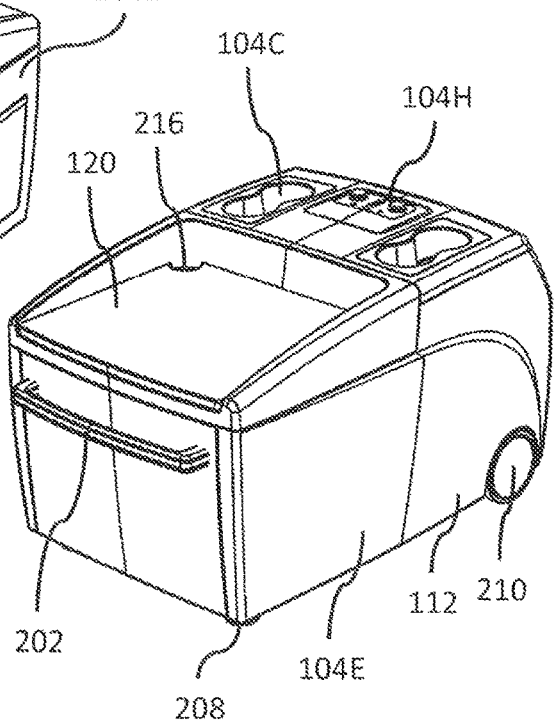
FIG. 6F

FIG. 7A
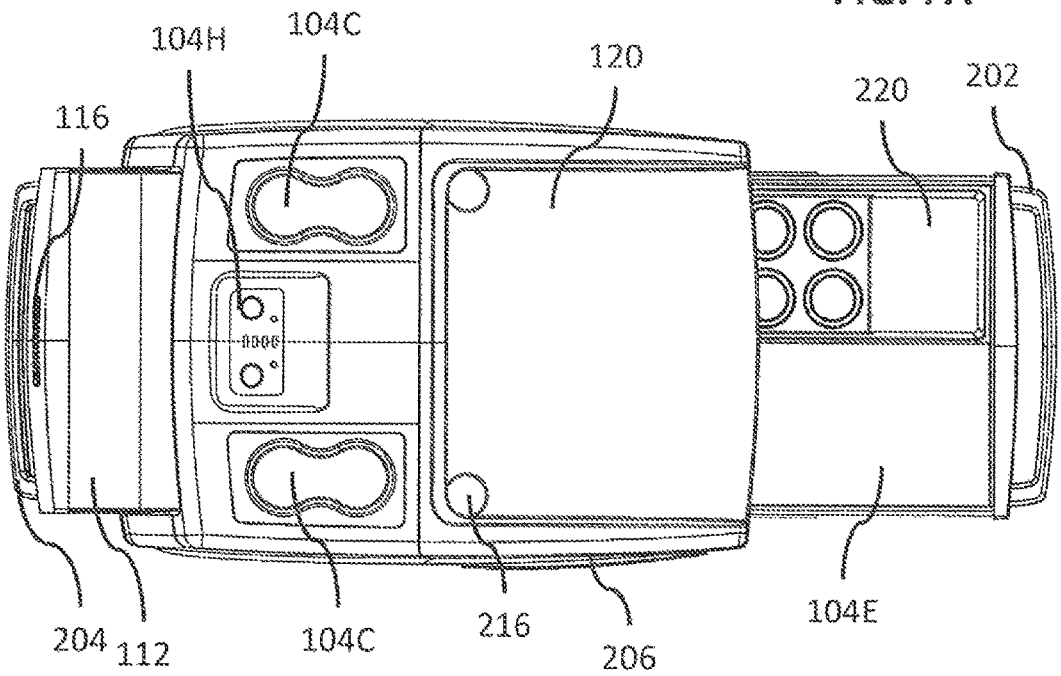
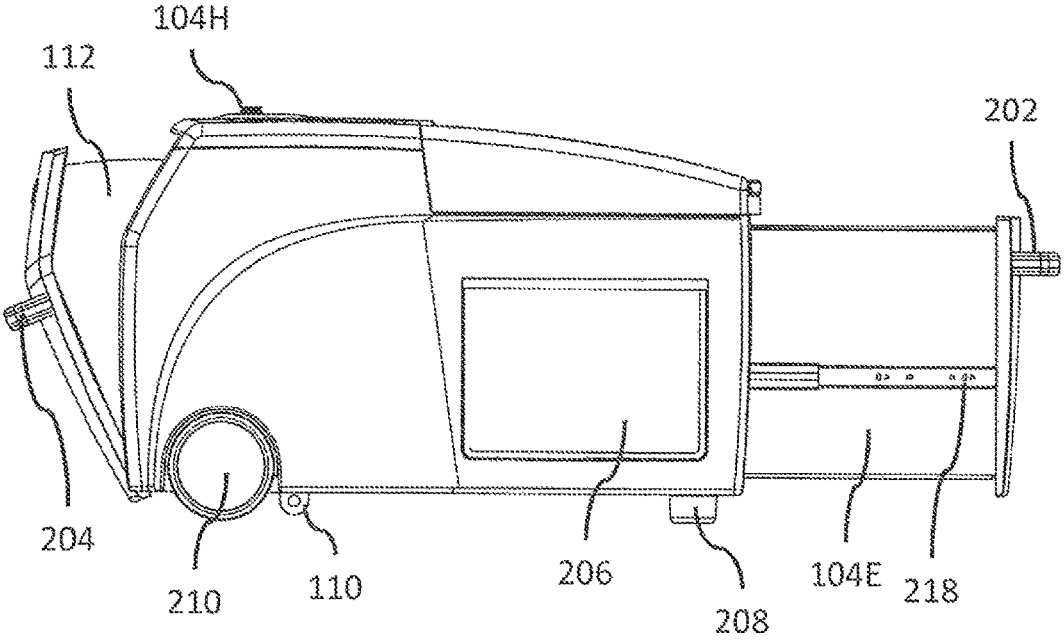
FIG. 7B

STORAGE ASSEMBLY HAVING USER-ACCESSIBLE COMPARTMENTS CATEGORIZED BY DIFFERENT LEVELS OF USER ACCESS

CROSS REFERENCE TO RELATED APPLICATIONS

This application is a continuation of U.S. patent application Ser. No. 15/661,274, filed on Jul. 27, 2017, which is a continuation of U.S. patent application Ser. No. 13/844,709, filed on Mar. 15, 2013, which claims the benefit of U.S. Provisional Patent Application No. 61/681,812 filed on Aug. 10, 2012. The entire contents of U.S. application Ser. No. 15/661,274, U.S. patent application Ser. No. 13/844,709 and U.S. Provisional Patent Application No. 61/681,812 are incorporated by reference herein.

FIELD OF THE INVENTION

The following relates generally to storage devices and more particularly to storage devices having a plurality of compartments.

BACKGROUND OF THE INVENTION

Garden furniture, also called patio furniture and outdoor furniture, is a type of furniture specifically designed for outdoor use. It is typically made of weather-resistant materials. The oldest surviving examples of garden furniture were found in the gardens of Pompeii (Italy). Garden furniture is often sold as a patio set consisting of a table, four or six chairs, and a parasol. A picnic table is used for the purpose of eating a meal outdoors.

A long chair (also referred to as a chaise longue) is also a common item. Patio furniture may be made from (or include) plastic, wood, aluminum, wicker, and/or wrought iron. Wooden garden furniture can suffer through exposure to the elements and therefore needs to be periodically treated. Teak is a commonly used material for outdoor furniture. Aluminum garden furniture is robust and long-lasting. However, if the protective coating is compromised it will corrode. Plastic garden furniture is naturally waterproof, so it can be left out year-round. Wicker outdoor furniture was originally made from the stems of any one of 600 species of palms found in tropical regions all over the world. The palm stems were tightly woven into interlocking panels, and formed into the desired structure. Now, most modern wicker furniture is made from synthetic resin, increasing the life expectancy and reducing manufacturing costs. Today's resin furniture is often made of recycled plastic and thus more durable, and it can be molded to resemble real wood or wicker.

A resort is a place used for relaxation or recreation, attracting visitors for holidays or vacations. Resorts are places, towns or sometimes commercial establishments. A resort or hotel is an example of a place that uses or deploys outdoor furniture.

SUMMARY OF THE INVENTION

The inventor has researched a problem associated with known outdoor furniture and similar sorts of furniture apparatus. After much study, the inventor believes he has arrived at an understanding of the problem and its solution, which are stated below.

For instance, in the past, the inventor vacationed at a hotel resort and enjoyed a facility of the hotel resort, such as (and not limited to) a swimming pool, a beach area, a recreation area, etc. The inventor desired to use the swimming pool, and thought it would be safe to leave some valuables (such as, money, credit cards, room key, jewelry, watches, electronic devices, etc.) on a table located adjacent to a chair next to the swimming pool since this situation did not appear to pose a problem in which the valuables may be stolen. However, that perception proved incorrect once the inventor came back to his chair and his valuables were missing, presumably stolen.

The inventor thought that there had to be a better way to contain items for a hotel guest on a temporary basis that may enhance the experience of the hotel guest. For example, users (such as hotel guests) may have security issues and/or safety issues (e.g., preventing theft of personal items, protecting personal items from sun, weather, wind, etc.), while catering to their personal needs and senses. Some users may want a limited set of features or components to suit their needs as desired.

In accordance with an aspect, there has been developed a furniture apparatus comprising an outdoor-storage assembly having user-accessible compartments arranged relative to each other, of which are categorized by different types of user access.

In accordance with another aspect there has been developed a method comprising categorizing user-accessible compartments of an outdoor-storage assembly of a furniture apparatus by different types of user access.

In accordance with another aspect, there has been developed a furniture apparatus comprising means for arranging user-accessible compartments of an outdoor-storage assembly of the furniture apparatus relative to each other, and means for configuring the user-accessible compartments in accordance with a category of different types of user access.

In accordance with another aspect, there has been developed a furniture apparatus comprising an outdoor-storage assembly having a safe assembly having a user-accessible storage area, and an electronic-locking mechanism configured to open the user-accessible storage area.

In accordance with another aspect, there has been developed a furniture apparatus comprising an indoor-storage assembly having user-accessible compartments arranged relative to each other, of which are categorized by different types of user access.

In accordance with another aspect there has been developed an apparatus comprising: a storage assembly having user-accessible compartments being arranged relative to each other, of which are categorized by different types of user access.

In accordance with another aspect there is provided a method comprising categorizing user-accessible compartments of an outdoor-storage assembly of a furniture apparatus by different types of user access.

In accordance with another aspect there is provided a furniture apparatus comprising means for arranging user-accessible compartments of an outdoor-storage assembly of the furniture apparatus relative to each other; and means for configuring the user-accessible compartments in accordance with a category of different types of user access.

In accordance with another aspect there is provided a furniture apparatus comprising an outdoor-storage assembly having: a safe assembly having: a user-accessible storage area; and an electronic-locking mechanism configured to open the user-accessible storage area. The furniture apparatus may further comprise a security-connection assembly configured to tether the safe assembly.

In accordance with another aspect there is provided a furniture apparatus comprising n indoor-storage assembly having: ser-accessible compartments being arranged relative to each other, of which are categorized by different types of user access.

In accordance with another aspect there is provided an apparatus comprising a storage assembly having: user-accessible compartments being arranged relative to each other, of which are categorized by different types of user access.

Other aspects and features of the non-limiting embodiments may now become apparent to those skilled in the art upon review of the following detailed description of the non-limiting embodiments with the accompanying drawings.

BRIEF DESCRIPTION OF THE DRAWINGS

Embodiments of the invention will now be described with reference to the appended drawings in which:

FIG. 6E is an isometric view of the furniture apparatus of FIG. 6A;

FIG. 6F is another isometric view of the furniture apparatus of FIG. 6A;

FIG. 7A is a top view of the furniture apparatus of FIG. 6A, with compartments in an open position;

FIG. 7B is a side elevation view of the furniture apparatus of FIG. 6A, with compartments in an open position;

Figure 1A:
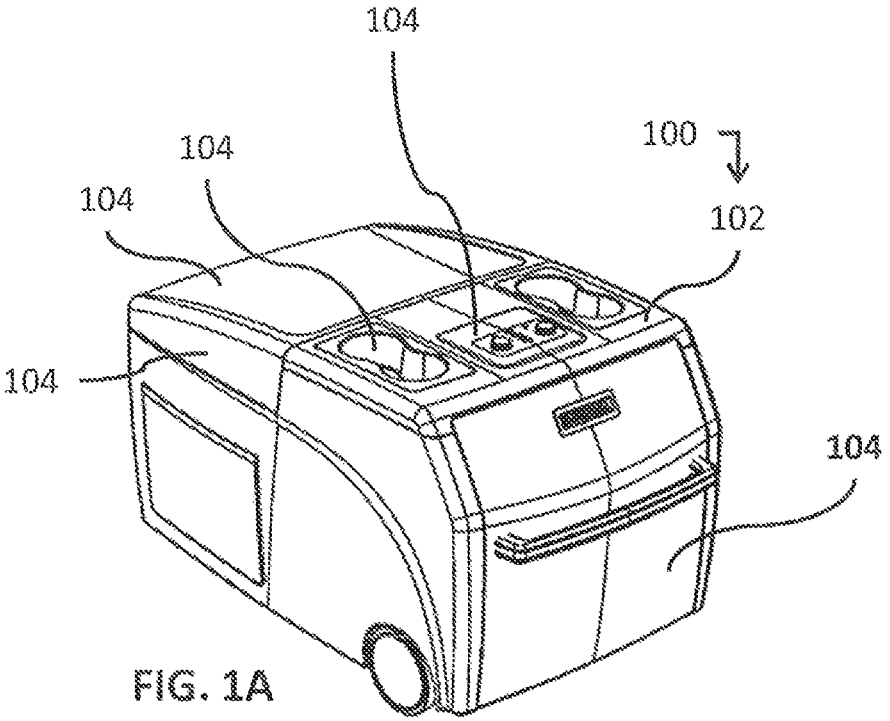
FIG. 1A is an isometric view of a furniture apparatus according to an embodiment.

The drawings are not necessarily to scale and may be illustrated by phantom lines, diagrammatic representations and fragmentary views. In certain instances, details not necessary for an understanding of the embodiments (and/or details that render other details difficult to perceive) may have been omitted.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the examples as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments (examples) aspects and/or concepts defined in the appended claims. Hence, specific dimensions and other physical characteristics relating to the embodiments disclosed herein are not to be considered as limiting, unless the claims expressly state otherwise.

With reference to all of the drawings, generally speaking, a furniture apparatus 100 includes (and is not limited to) an outdoor-storage assembly 102 having user-accessible compartments 104. The outdoor-storage assembly 102 may be called patio furniture or outdoor furniture. The furniture apparatus 100 includes weather-resistant materials, components, sub-assemblies, and assemblies. The furniture apparatus 100 may be used at a beach, pool, hotel, resort, an outdoor facility, etc.

FIG. 1A is an isometric view of a furniture apparatus according to an embodiment. Furniture apparatus 100 may be positioned adjacent to a chair assembly (that may be called an outdoor leisure chair, a lounge chair assembly or a poolside chair assembly, etc.). The furniture apparatus 100 may be positioned between two chair assemblies if so desired. The user-accessible compartments 104 are arranged relative to each other, and of which are categorized by different types of user access.

The furniture apparatus shown in FIG. 1A has several user-accessible compartments 104. Examples of the types of user-accessible compartments 104 are depicted in other Figures. Moreover, the following description relating to FIG. 1A is focused on a generic description of the user-accessible compartments 104. More specifically, the user-accessible compartments 104 are categorized by different types of user access (that is, categorized by different types of user-accessibility). The user-accessible compartments 104 are configured for uses such as (and not limited to) receiving, storing, and/or presenting items (user items or other items) and/or other possible uses and/or functions, as identified below. By way of example, the user-accessible compartments 104 may include a secured (lockable) user-accessible compartment (or section) configured to permit authorized user access while preventing unauthorized user access. The secured user-accessible compartment may include a secured door assembly configured to permit authorized user access (to the contents of the secured user-accessible compartment), along with an assembly configured to gain authorized access, such as a physical key, or by swiping a plastic identification card through a card-reader device, or by way of a proximity-swipe badge, or a keypad device, etc.

In addition, the user-accessible compartments 104 may also include an unsecured user-accessible compartment that may or may not have a door assembly configured to permit unrestricted or unsecured user access to the contents of the user-accessible compartments. The unsecured user-accessible compartment is configured to permit unrestricted user access (to anyone or any user). The furniture apparatus 100 may be incorporated in: (A) a table assembly that may be positionable next to the chair assembly, (B) the chair assembly, and/or (C) any type of outdoor furniture. For instance, the user-accessible compartments 104 of the furniture apparatus 100 may be supported by the table assembly. The furniture apparatus 100 may mimic a table apparatus. The furniture apparatus 100 may further include a frame assembly configured to support (relative positioning of or orientation of) the user-accessible compartments 104. The frame assembly is also configured to support an outer-panel assembly that may include a set of outer-panel units that are designed or configured to complete (define) the outer surface treatment of the furniture apparatus 100. The outer-panel units may be designed to satisfy a particular aesthetic design requirement. The components of the outer-panel assembly may be constructed at least in part, of a molded plastic body treated with a UV (ultra violet) light protection. The members of the set of outer-panel units may be inter-lockable (configured to fit or interlock with) with at least one other member and/or with the frame assembly.

In accordance with the embodiment depicted in FIG. 1A, the furniture apparatus 100 includes an outer peripheral zone or outer surface, and the user-accessible compartments 104 are operatively mounted to or positioned relative to the outer peripheral zone. The user-accessible compartments 104 may be nested one within another if so desired or required. The user-accessible compartments 104 are configured to receive and to store or retain personal items or non-personal items.

Figure 1B:
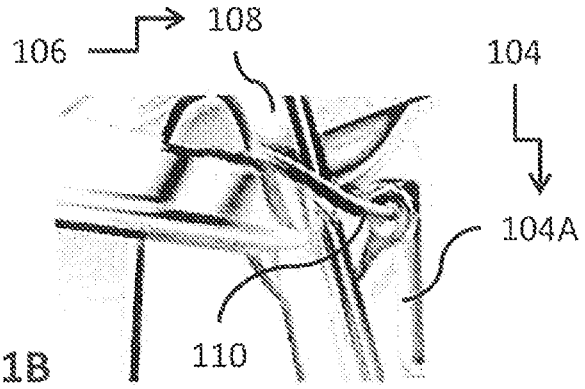
FIG. 1B is an enlarged partial isometric view of the furniture apparatus of FIG. 1A positioned adjacent to a chair.

FIG. 1B is an enlarged partial isometric view of the furniture apparatus of FIG. 1A positioned adjacent to a chair assembly 106 having a frame assembly 108. The user-accessible compartments 104 include a compartment 104A that has, or is configured to accommodate, a security-connection assembly 110. The security-connection assembly 110 is configured to securely connect the outdoor-storage assembly 102 to a stationary object or to an object that is not easy to move around, such as chair assembly 106. As depicted in FIG. 1B, the security-connection assembly 110 is configured to securely connect, via latch or tether, the outdoor-storage assembly 102 to the frame assembly 108 of the chair assembly 106. The security-connection assembly 110 may include a lockable mechanism configured to securely position the outdoor-storage assembly 102 to the chair assembly 106. For instance, the security-connection assembly 110 may include a tether device and/or a lockable tether. By way of example, the tether device may include a cord loop configured to facilitate secured connection. The compartment 104A may be configured to be accessible by hotel or facility staff or other such authorized user. In view of the foregoing, the compartment 104A is categorized as a secured (lockable) user-accessible compartment.

Figure 2A:
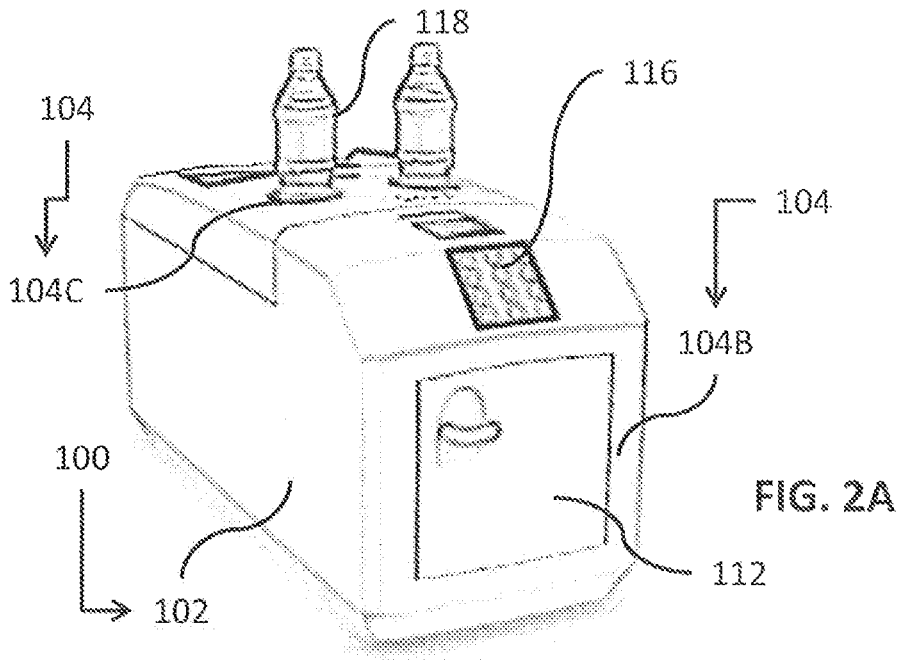
FIG. 2A is an isometric view of a furniture apparatus according to another embodiment.
Figure 2B:
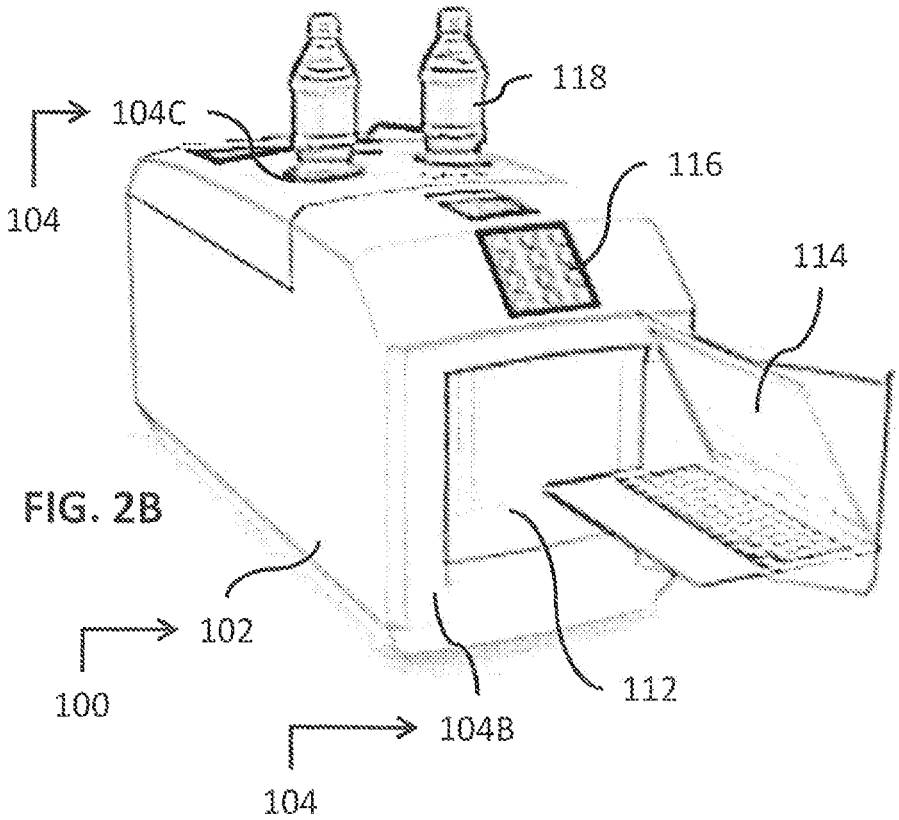
FIG. 2B is an isometric view of a furniture apparatus of FIG. 2A, with a compartment having been opened.

Referring now to the examples depicted in FIGS. 2A and 2B, there are depicted perspective views of the furniture apparatus 100. The furniture apparatus 100 is adapted such that the user-accessible compartments 104 include a compartment 104B that has, or is configured to accommodate, a safe assembly 112. The safe assembly 112 may be called a combination safe, a strongbox, etc. The safe assembly 112 is a secure lockable device configured to secure valuable objects against theft and/or damage and preventing unauthorized user access. The safe assembly 112 may include, for example, a hollow cuboid or cylinder, with one face removable or hinged to form a door. The body and door of the safe assembly 112 may be cast from metal such as steel or formed out of plastic through blow molding. A less secure version, suitable for petty cash, is usually called a cash-box. The compartment 104B is categorized as a lockable user-accessible compartment. The safe assembly 112 is configured to securably lock personal items, such as a laptop computer 114, a hotel room key, a wallet, money, jewelry, a personal digital assistant (PDA), and/or a cell phone. The safe assembly 112 is configured to be received and support by the frame assembly of the furniture apparatus 100. Advantageously, the safe assembly 112 is configured to prevent theft of items while the user is engaged with other activities, such as using a swimming pool, using a gym, or while engaged with other activities. The safe assembly 112 provides convenience to the user, without requiring the user to place their personal items back in their hotel room or at the front desk of the hotel, etc.

For example, the safe assembly 112 may include a keypad assembly 116 configured to permit entry of a pass code by the user in order to gain authorized access to the contents of the safe assembly 112. The pass code may be assigned to the user by administration staff of the hotel. Other ways of gaining authorized access to the compartment 1048 may be used.

FIG. 2A is an isometric view of a furniture apparatus according to another embodiment. FIG. 2A depicts the example of the safe assembly 112 in a closed secured position; that is, the door of the safe assembly 112 is locked shut to prevent unauthorized access to the contents of the safe assembly 112.

FIG. 2B depicts the example of the safe assembly 112 in an open position; that is, the door is open to permit authorized user access to the contents of the safe assembly 112. The door of the safe assembly 112 (depicted in FIGS. 2A and 2B) is hinged connected along a vertical side of the door. It will be appreciated that other configurations may be used to operatively attach the door of the safe assembly 112 relative to the components of the furniture apparatus 100.

The user-accessible compartments 104 further include a compartment 104C that has, or is configured to accommodate, a drink container 118. The compartment 104C is categorized as an unsecured user-accessible compartment. The compartment 104C may be called a cup holder.

Figure 3A:
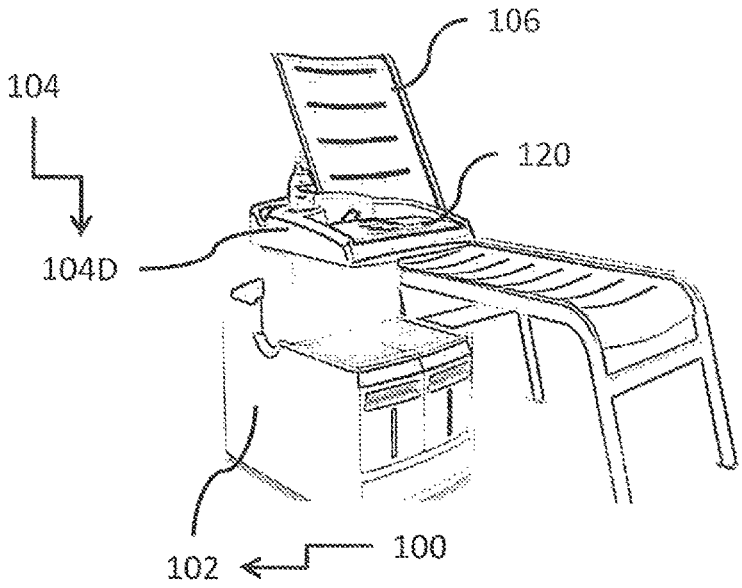
FIG. 3A is an isometric view of a furniture apparatus according to another embodiment, positioned beside a lounge chair.
Figure 3B:
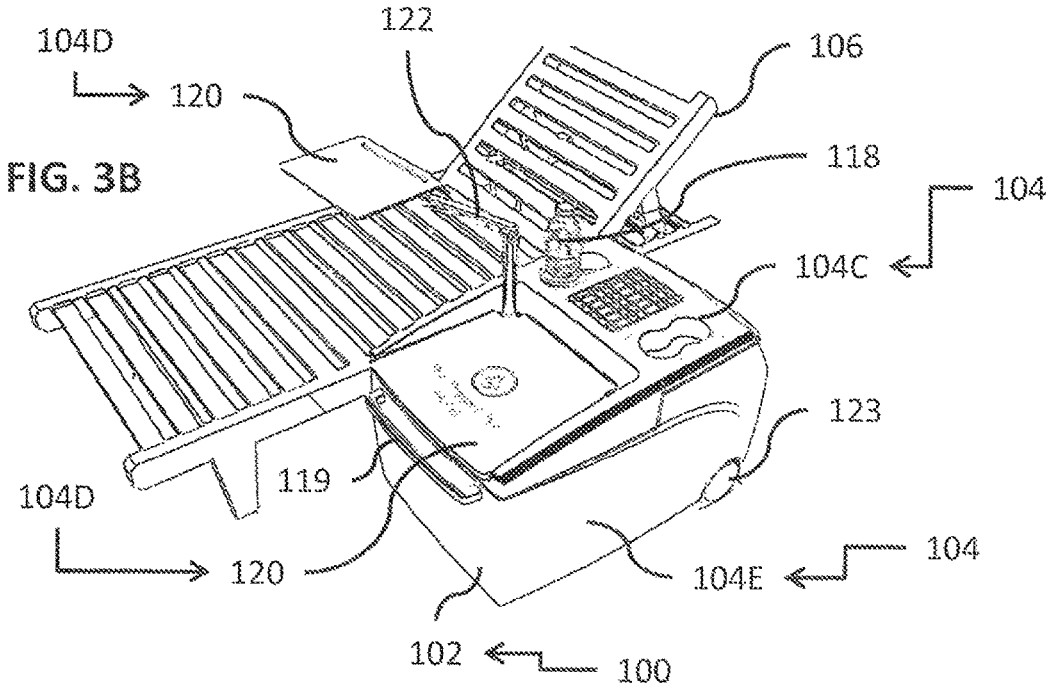
FIG. 3B is an isometric view of a furniture apparatus according to yet another embodiment, positioned beside a lounge chair.

FIG. 3A is an isometric view of a furniture apparatus 100 according to another embodiment, positioned beside a lounge chair, and FIG. 3B is an isometric view of a furniture apparatus according to yet another embodiment, positioned beside another lounge chair. The furniture apparatus 100 is adapted such that the user-accessible compartments 104 include a compartment 104D that has (or is configured to accommodate) a user surface 120. The compartment 104D is categorized as an unsecured user-accessible compartment. The user surface 120 is configured to support a laptop computer, food, drinks, user items, etc. The user surface 120 may be called a tabletop. The frame assembly may be configured to support the user surface 120. The user surface 120 of the example depicted in FIG. 3A is configured to support user items to one side of the user. In sharp contrast, the user surface 120 of the example depicted in FIG. 3B is configured to support user items in front of the user. According to the example depicted in FIG. 3B, an instance of the user surface 120 is attached to (pivotally or rotatably mounted to) a retractable arm 122, so that the user surface 120 may present an increased overall work surface to the user.

FIG. 3B depicts the example of the frame assembly, in which the frame assembly is configured to permit rotatable movement of the retractable arm 122 along a longitudinal axis extending vertically through the retractable arm 122. Specifically, the frame assembly is configured to permit translation of the user surface 120 along a horizontal direction. A spring mechanism may be used to facilitate ease of manual movement of the retractable arm 122 as desired by the user. In sharp contrast, FIG. 3A depicts the example of the frame assembly in which the frame assembly is configured to permit linear translation of the user surface 120 along a vertical direction. FIG. 3A depicts the example of the user surface 120 extended to a protracted position, and in the retracted position the user surface 120 is positioned (relatively) lower.

Referring now to the example depicted in FIG. 3B, the user-accessible compartments 104 include a compartment 104E that has (or is configured to accommodate) a cooling assembly configured to cool (to keep cool) an item. The compartment 104E may be categorized as a secured (lockable) user-accessible compartment or may be categorized as an unsecured user-accessible compartment. The cooling assembly may be called a cooler, cool box, a portable ice chest, a chilly bin, or an insulated box. The cooling assembly is configured to keep items cool (such as food and/or drink). Ice cubes may be placed in the cooling assembly to help maintain or keep the items held inside cool. The cooling assembly may contain or isolate melting water from the ice packs away from the items to be cooled. According to another option, the cooling assembly is configured to receive a gel pack that advantageously stays colder relatively longer than plain ice (absorbing heat as the gel pack changes phase). According to another option, the cooling assembly may include a bucket device (tray) configured to receive and store bottles of water, wine, juices, milk, a bottle of vodka, food item, etc. Generally speaking, the cooling assembly is configured to cool, at least in part, a food item (such as a drink). For instance, the cooling assembly may be in thermal communication with the gel pack assembly that may be cooled overnight and then may be installed by a hotel employee. Some gel pack assemblies are configured to provide a cooling effect for 15 hours. Alternatively, the cooling assembly may derive power from electrical voltage mains. For instance, a locally installed electrical outlet may be positioned adjacent to the furniture apparatus 100, and the cooling assembly may be plugged into the electrical outlet.

In accordance with an option, the furniture apparatus 100 is adapted so that the user-accessible compartments include: a first compartment and a second compartment located relative to the first compartment. The first compartment has a safe assembly 112 (of FIGS. 2A, 2B) configured to secure objects against unauthorized user access. The second compartment has a cooling assembly (of FIG. 3B) configured to cool an item.

In accordance to the example depicted in FIG. 3B, the frame assembly of the furniture apparatus 100 has (or is configured to accommodate) a transport assembly 123. The transport assembly 123 is configured to facilitate transport of the frame assembly. For instance, the transport assembly 123 includes a pair of wheels disposed on opposite sides of the furniture apparatus 100, so that the furniture apparatus 100 may be conveniently moved by hotel staff for repair, service, clean up, etc. A handle 119 is mounted to an opposite side from the transport assembly 123 so that one end of the furniture apparatus 100 may be moved upwardly thus permitting movement (rolling transport) of the furniture apparatus 100 by way of the transport assembly 123. The handle 119 may include a strap to simplify the construction of the furniture apparatus 100.

Figure 4A:
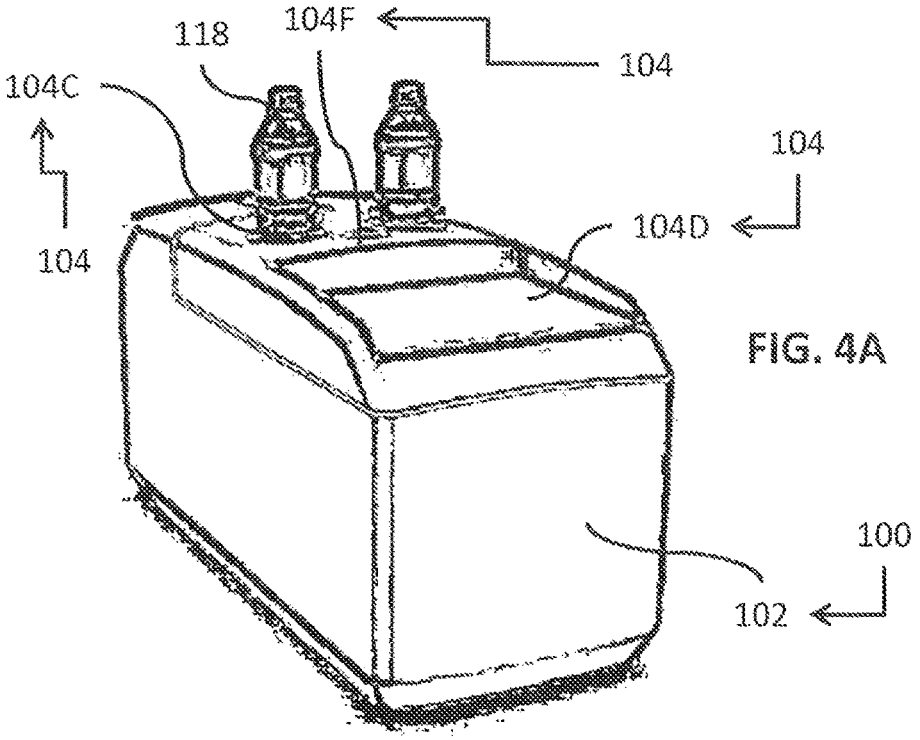
FIG. 4A is an isometric view of a furniture apparatus having a service request assembly.
Figure 4B:
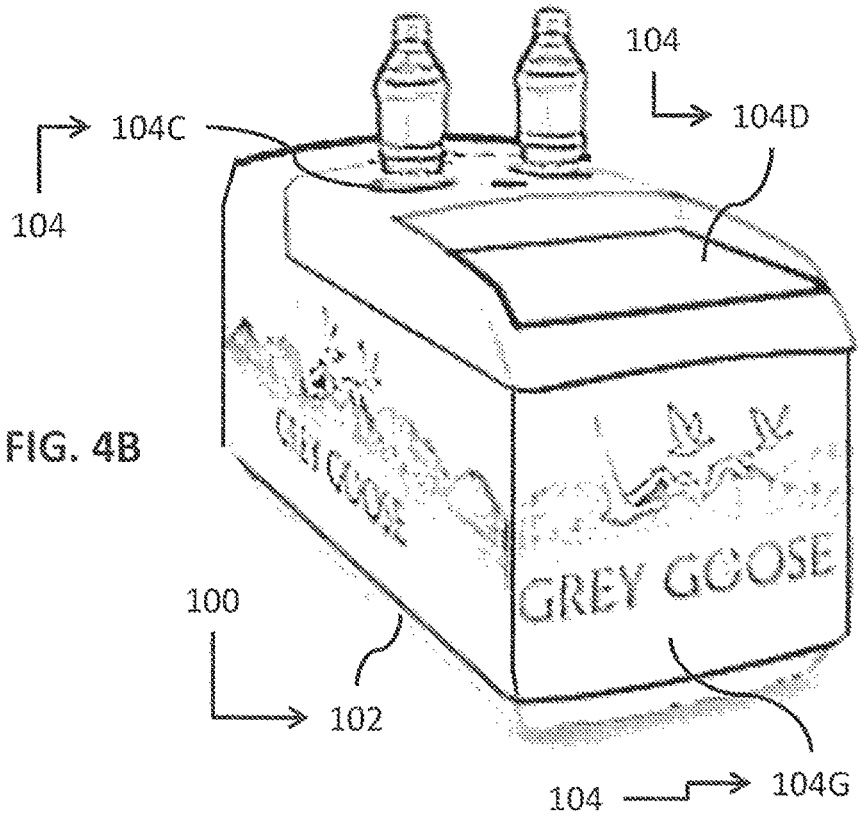
FIG. 4B is an isometric view of a furniture apparatus with branding support/display surfaces.

FIG. 4A is an isometric view of a furniture apparatus having a service request assembly, and FIG. 4B is an isometric view of a furniture apparatus with branding support/display surfaces. The compartment 104F may be categorized as a secured user-accessible compartment. The service-request assembly is configured to send (electronically) a request for service in response to the needs of the user. The compartment 104F may include a push-button assembly configured to request a call (initiated by the user) for service, such as a user request for food items, drink service, emergency assistance, etc. The compartment 104F is configured to send a request signal to a receiver assembly located remote from the furniture apparatus 100. In addition, a two-way speaker apparatus may be installed in the furniture apparatus 100 to facilitate two way communications with a service provider (such as a hotel employee located at the bar or restaurant, or other department of the hotel).

FIG. 4B depicts the example of a case where the user-accessible compartments 104 include a compartment 104G that is generally a branding support surface suitable for supporting or displaying an advertising logo or other form of advertising media. The advertising media may be applied directly or indirectly to the outer surface of the furniture apparatus 100. The advertising logo may be directly affixed to the compartment 104G. For instance, a place holder may extend from the furniture apparatus 100, and the advertising media is attached to the place holder. In addition, the user surface 120 may be adapted to position a pad having a design, such as the logo of the hotel or resort, brand name of a consumer product or service, etc. The compartment 104G is categorized as an unsecured user-accessible compartment. The compartment 104G enhances awareness to the user of available items and/or services that may be requested from the service provider. The compartment 104G may have a programmable display assembly that can change the image (information) displayed to the user. The programmable display assembly may be used to display advertising information and/or to display information such as weather conditions, hotel events, time of day, etc. (in two dimensions and/or in three dimensions). The programmable display assembly may include a touch-screen display, a smart screen, or a non-touch screen display. The programmable display assembly may present internet-based web pages having information, etc. As well, the programmable display assembly may be configured to display electronic games to the user.

Figure 5:
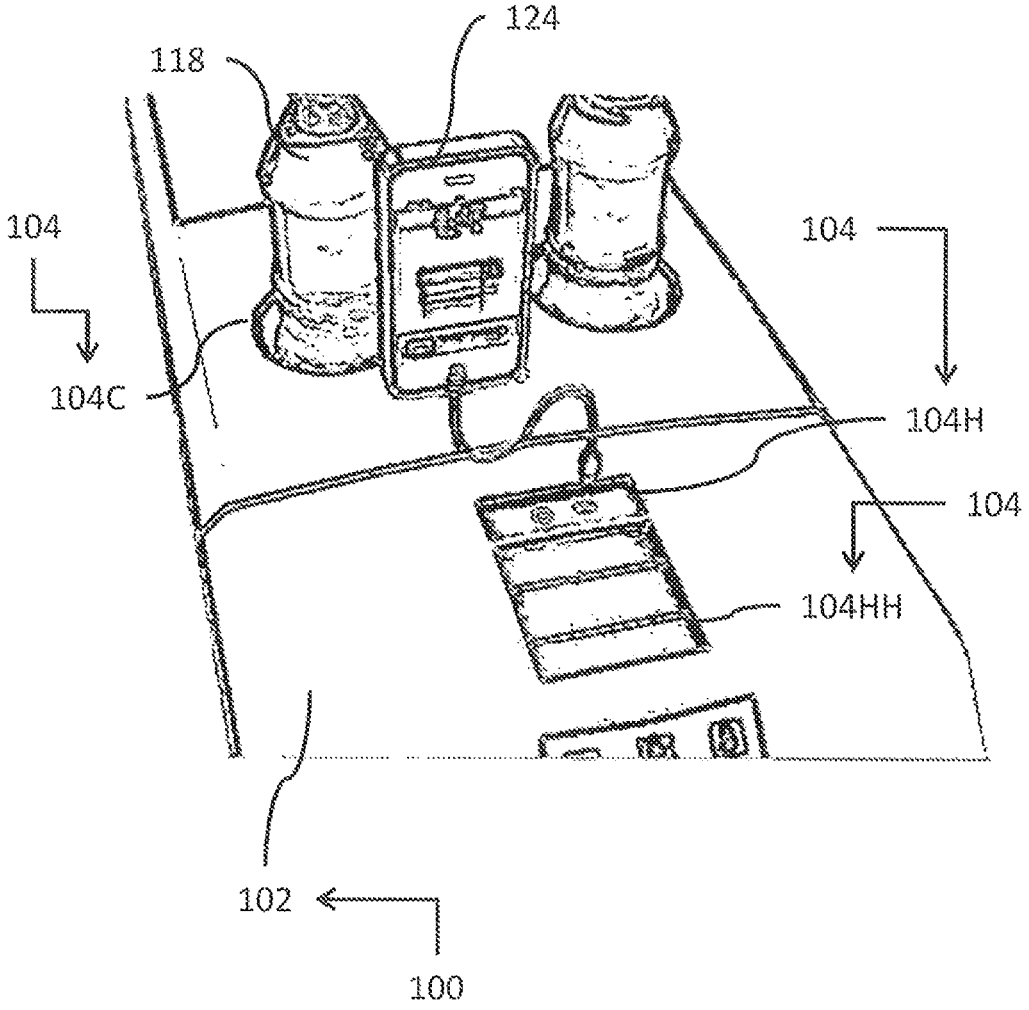
FIG. 5 is an enlarged isometric view of a portion of a furniture apparatus, according to an embodiment.

Referring now to the example depicted in FIG. 5, there is depicted a partial close-up perspective view of the furniture apparatus 100, in which the user-accessible compartments 104 include a compartment 104H that has (or is configured to accommodate) a recharging station. The compartment 104H may be categorized as a secured user-accessible compartment or as an unsecured user-accessible compartment. The recharging station is configured to recharge a battery assembly of an electronic device 124, such as a cell phone, a laptop computer, etc. For instance, the recharging station may include a charger pad mounted to an outer surface of the furniture apparatus 100. Generally speaking, the compartment 104H is configured to include an electronic-support device (keyboard, keypad, a recharging station. etc.). The electronic-support device is configured to provide support to electronic devices such as cell phones, computers, etc. As an option, the user-accessible compartments 104 include a compartment 104HH that has (or is configured to accommodate) solar cells configured to support the compartment 104H, or alternatively, the compartment 104H may be powered by mains voltage.

Other variations for the user-accessible compartments 104 are contemplated. For example, the user-accessible compartments 104 may further include a compartment that has (or is configured to accommodate) a boutique assembly configured to present items for sale (to the user, at hotel discretion). This compartment may be a type of secured compartment. By way of example, the boutique assembly is depicted in the top view of the furniture apparatus shown in FIG. 8.

For instance, the user-accessible compartments 104 may further include a compartment that has (or is configured to accommodate) a communications device. The communications device is configured to facilitate user communication. For instance, the communications device may be a telephone configured to facilitate telephone calls such as hotel house calls, local calls, long distance calls, etc. This compartment may be a type of secured compartment if the communications device is restricted to hotel calls only (for example).

For instance, the furniture apparatus 100 may be further adapted such that the user-accessible compartments 104 include a compartment having a table assembly.

For instance, the user-accessible compartments 104 may further include a compartment having a magazine-rack assembly configured to receive and support a user item (for the convenience of the user). It is understood that the user item may include one or more user items. This compartment may be a type of unsecured compartment. The magazine-rack assembly may include a fold-out device positioned on a side of the furniture apparatus 100, and is configured to accommodate and/or display magazines, books, provide extra storage, etc.

For instance, the user-accessible compartments 104 may further include a compartment that has (or is configured to accommodate) an entertainment unit, such as a radio assembly, an electronic gaming console, a compact disk (CD) assembly, a device configured to have pre-loaded music, etc. This compartment may be a type of unsecured compartment. The entertainment unit may include a head-phone plug-in jack in which the user may plug in a head phone (for private listening).

For instance, the user-accessible compartments 104 may include a compartment that has (or is configured to accommodate) a financial-transaction device. The financial-transaction device is configured to facilitate financial transactions, such as of the type of financial transaction associated with purchasing an item or a service, such as for ordering food, drink, hair salon service, etc. A transaction-swipe device or a room key, etc., may be used to facilitate the financial transaction for purchasing the item or service. This compartment may be a type of secured compartment.

Generally speaking, the furniture apparatus 100 is adapted such that the user-accessible compartments include various sorts or types of assemblies or devices. For instance, the user-accessible compartments 104 may include a transaction-swipe device configured to identify items removed by a user, and to account for any removed items that may be invoiced later to the user upon checkout by the user from the hotel.

For instance, the user-accessible compartments 104 may include a bio-identification device configured to authenticate user access to at least one compartment of the furniture apparatus 100. The user may pay for the loan of the furniture apparatus 100 from the hotel, and the hotel may then use the bio-identification device to identify the items that the user removed from the furniture apparatus 100 (so that the user may be subsequently invoiced for the removed items).

For instance, the user-accessible compartments 104 may include a status-indicator device configured to show (display an indication of) an availability indicia associated with the furniture apparatus 100. The availability indicia is configured to indicate or to display the availability status of the furniture apparatus 100; the status may be "currently in use" or "available for use".

For instance, the user-accessible compartments 104 may include a social-networking device configured to facilitate social networking for the user, such as facilitating connections with (introductions between) users that have similar interests, such as hobbies, romance, etc.

For instance, the user-accessible compartments 104 may include a reservation device configured to indicate when a restaurant table is ready for use by the user. The user-accessible compartments 104 may include an intercom configured to facilitate communications in order to process a request to reserve a table at a restaurant, or request service from a service provider, or request items for sale, or request complementary items.

For instance, the user-accessible compartments 104 may include a computing device configured to permit the user to perform computing tasks, such as electronic gaming, checking stock prices, checking and responding to e-mails, viewing web pages, etc.

For instance, the user-accessible compartments 104 may include a compartment that has (or is configured to accommodate) an alarm assembly. This compartment is a type of secured compartment. The alarm assembly is configured to provide indication of unauthorized movement of (and/or unauthorized access to) at least one compartment of the user-accessible compartments 104. For instance, the alarm assembly may include a tracking device, such as a global position system (GPS) that is configured to broadcast a position of the furniture apparatus 100 so that the furniture apparatus 100 may be tracked and found if so required. Optionally, the user-accessible compartments 104 may include a compartment that has (or is configured to accommodate) a tracking device configured to broadcast a position of the furniture apparatus 100 to an associated or compatible signal-receiving and tracking device.

According to an option, the furniture apparatus 100 may be configured or so arranged so as to be stackable, one above the other configuration, or in a side-by-side configuration. The furniture apparatus 100 includes a frame assembly that is stackable (and/or connectable) with another frame assembly of another furniture apparatus 100.

The furniture apparatus 100 may be designed so as to have ornamentation qualities such as different colours and textures, such as brown trim with stainless steel inserts, or teak wood or black plastic with a white plastic trim, etc.

According to an option, the furniture apparatus 100 is adapted such that the user-accessible compartments include a cool-off device configured to cool down a user. The cool-off device may include a water spray, a water spritzer, a water mister, etc.

According to an option, the furniture apparatus 100 is adapted such that the user-accessible compartments are supported by another furniture assembly such as a table assembly, a couch, a chair, a console, a cabana, etc.

In view of the above description, it will be appreciated that a method is disclosed. The method includes categorizing the user-accessible compartments 104 of an outdoor-storage assembly 102 by different types of user access. As well, the furniture apparatus 100 may be described as having or including (broadly speaking): (A) means for arranging the user-accessible compartments 104 of an outdoor-storage assembly 102 relative to each other, and (B) means for configuring the user-accessible compartments 104 in accordance with a category of different types of user access. For example, the means for arranging includes the frame assembly. The means for configuring includes installation of user-accessible compartments 104 categorized by different types of user access to the frame assembly.

It is understood that for the case where a component of the furniture apparatus 100 includes an item, it should be understood that the furniture apparatus 100 may include one or more instances of the item. For example, for the case where the furniture apparatus 100 includes a safe assembly 112, it should be understood that the furniture apparatus 100 includes one or more of the safe assembly 112, and not necessarily limited to one instance of the safe assembly 112.

In accordance with yet another example there is provided a furniture apparatus 100 comprising an outdoor-storage assembly having a safe assembly 112. The safe assembly 112 has a user-accessible storage area. The safe assembly 112 has an electronic-locking mechanism configured to open the user-accessible cavity. Examples of the electronic-locking mechanism include a keypad, a swipe-card mechanism, a wireless device, proximity card, a retina scan mechanism, a finger print scanning mechanism, etc. The furniture apparatus may further include a security-connection assembly 110 configured to tether the safe assembly 112.

In accordance with yet another example there is provided a furniture apparatus comprising an indoor-storage assembly having user-accessible compartments arranged relative to each other of which are categorized by different types of user access. The indoor-storage assembly may be similar to the outdoor storage assembly, and the indoor-storage assembly may include suitable (materials, construction, etc.) for use in indoor scenarios or indoor settings such as hospitals, airports, very important person (VIP) lounges of an airport, old age homes, retirement homes, schools, shopping centers or malls, bus depots, train depots, any type of transportation hub or transportation center, indoor lounge settings, sport arenas, movie theatres, live theatre facilities, amusement parks, public-use areas, and/or at private residences for personal use at home, etc. The indoor-storage assembly may use or incorporate any compartment described above in association with the furniture apparatus 100.

In one embodiment, the indoor storage assembly is adapted for use in a night club, and has user-accessible compartments for storing shot glasses, tumblers, and the like, as well as user-owned effects such as smart/cell phones, purses, coats and the like. A visitor or group of visitors to the night club could rent or prearrange to have access to an indoor storage assembly for making their visit to the night club even more enjoyable. Containers for housing ice and bottles may be provided either within a compartment or on top of the unit for ease of access, and may be kept cool by a refrigeration device incorporated within the indoor storage assembly. A drawer or other compartment may be provided that can store footwear of the users, such as shoes. The drawer can also store slippers that the users can exchange with their own shoes to remain comfortable while enjoying the night club. Lighting may be provided in various compartments so that the contents can easily be seen in a darkened night club, when the compartments are opened. Similar other features such as have been described above could be incorporated into the indoor storage assembly, such as display screens and other aspects.

In one embodiment, a service model may be arranged in connection with an indoor or outdoor storage assembly, such that certain compartments may be made accessible to the user and selectively lockable depending on whether the user has paid for premium access, normal access, or somewhere in between. For example, access to a lockable compartment sized for purses, or sized for smart/cell phones and charging may require payment of a premium. It may be that a user may wish to pay extra for use of a service call feature that, if not paid for, would not be actuatable. It may be that a user would not want to pay extra for a lockable shoe drawer. It may be that two users may wish to have differential access to different compartments, such as may be the case where a night club arranges for two different groups to use different compartments in a single furniture apparatus. Various service models could be arranged so that the users can self-select the level of service that may be provided in connection with the storage assembly.

Figure 6A:
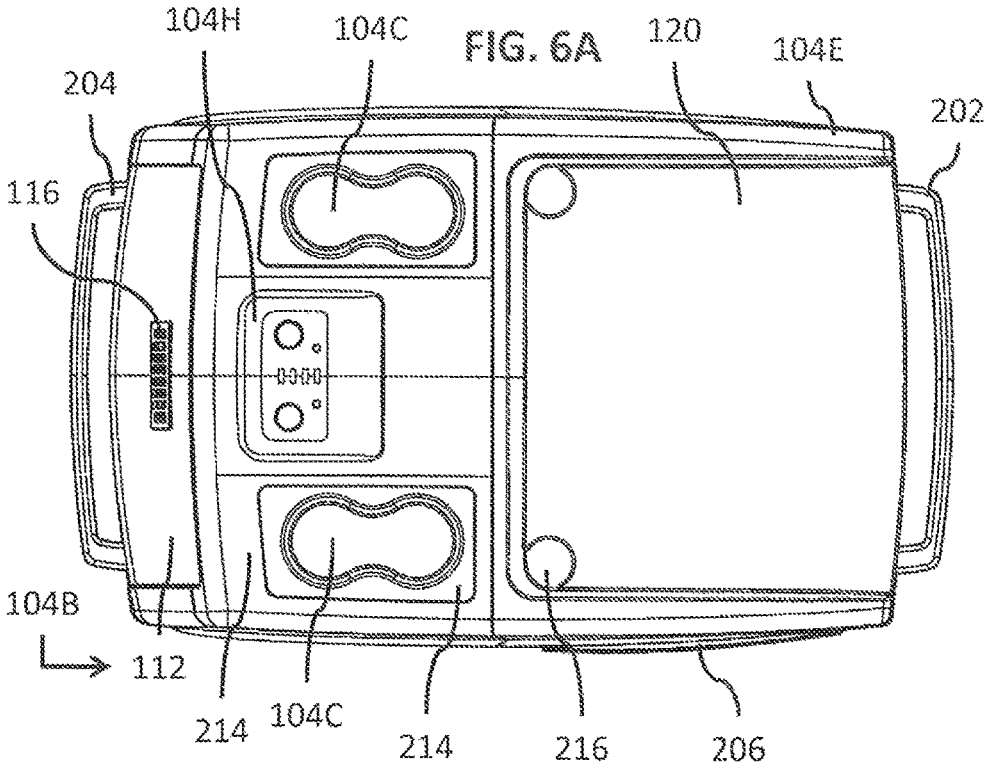
FIG. 6A is a top view of a furniture apparatus, according to an embodiment.

Referring now to FIGS. 6A, 6B, 6C, 6D, 6E and 6F there are depicted examples of the furniture apparatus 100 in which the user-accessible compartments 104 are placed in a closed position or condition. FIG. 6A depicts the top view of the example of the furniture apparatus 100 in the closed position. A handle 202 is attached or coupled to the compartment 104E. The handle 202 extends substantially laterally (horizontally or vertically or diagonally) across a front panel of the compartment 104E. For instance, the compartment 104E may include the cooling assembly. A handle 204 is attached to the compartment 104B. For instance, the compartment 104B includes the safe assembly 112 having the keypad assembly 116 mounted to an outer surface of the safe assembly 112, so that a user may have access to the keypad assembly 116. The keypad assembly 116 may include a user-programmable digital display. The handle 204 extends substantially laterally (horizontally, vertically or diagonally) across a front panel of the compartment 104B.

A magazine rack assembly 206 is attached to a side wall of the compartment 104E. The furniture apparatus 100 includes a top surface configured to support or to provide the compartment 104C. For instance, the compartment 104C includes a cup holder and/or a drink holder. The furniture apparatus 100 also includes at least one or more instances of an outer-panel section 214 that cooperatively fit (interface) with at least one other outer-panel section and/or with the frame assembly, thereby forming an outer-facing surface of the furniture apparatus 100. The furniture apparatus 100 also includes the compartment 104H mounted to a top surface of the furniture apparatus 100. As depicted, the compartment 104H may be mounted over or above (proximate to) the safe assembly 112. The furniture apparatus 100 also includes the user surface 120 that may be configured to receive a removable-pad structure. The removable-pad structure may be fitted or sized to fit in the user surface 120. The user surface 120 (work surface) also includes a provision 216 configured to receive a rotatable arm for supporting a table surface (as depicted in FIG. 3B).

Figure 6B:
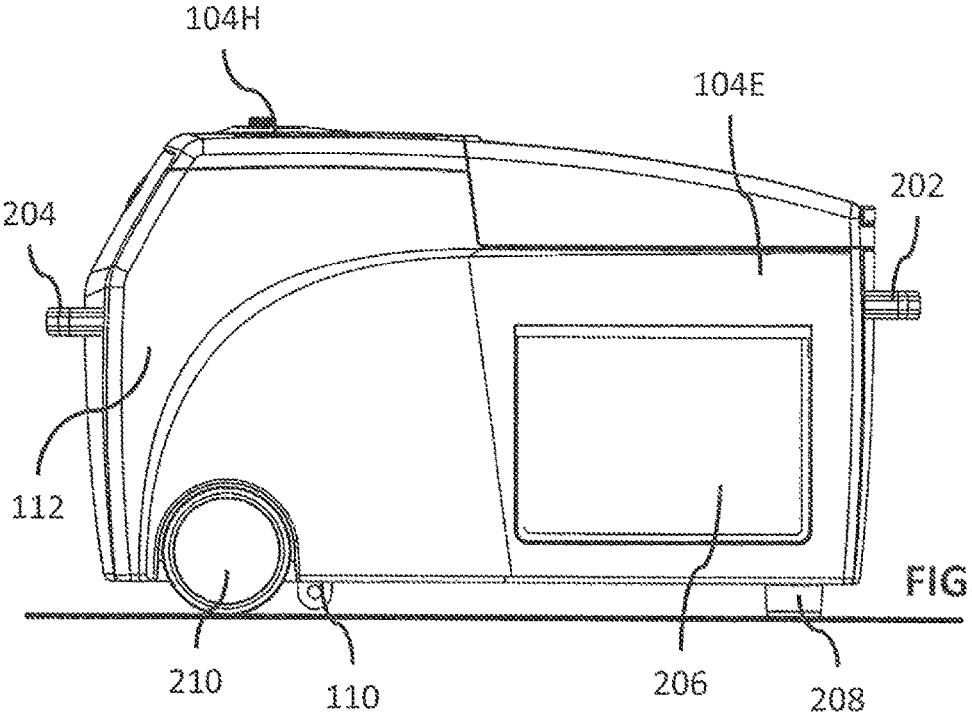
FIG. 6B is a side elevation view of the furniture apparatus of FIG. 6A with compartments in a closed position.

FIG. 6B depicts the side view of the furniture apparatus 100 placed in the closed position. The magazine rack assembly 206 is mounted to (positioned on) a side panel of the compartment 104E. The furniture apparatus 100 further includes a stand assembly 208 that extends (downwardly to the ground) from one side of the furniture apparatus 100. Specifically (as depicted), the stand assembly 208 extends from a bottom portion of the compartment 104E. The stand assembly 208 is configured to support positioning of the furniture apparatus 100. A wheel assembly 210 is set apart from the stand assembly 208, and is operatively mounted to a bottom section of the furniture apparatus 100. For the case where a user manually lifts the handle 202, the stand assembly 208 becomes lifted or displaced away from the ground, so that the user may push the furniture apparatus 100 thus causing the wheel assembly 210 to rotate, and thus permit movement of the furniture apparatus 100. The wheel assembly 210 may be positioned lower than the bottom edge of the furniture apparatus 100 so as to facilitate a larger degree of rotation of the furniture apparatus 100 once the user pulls upwardly on the handle 202. It is understood that the wheel assembly 210 and the stand assembly 208 are optional items or assemblies. A security-connection assembly 110 depends (extends downwardly) from the furniture apparatus 100, and as depicted the security-connection assembly 110 extends from a bottom edge of the safe assembly 112, and is securely coupled to the safe assembly 112. As depicted, the security-connection assembly 110 may include a plate defining a hole configured to receive cable lock assembly.

Figure 6C:
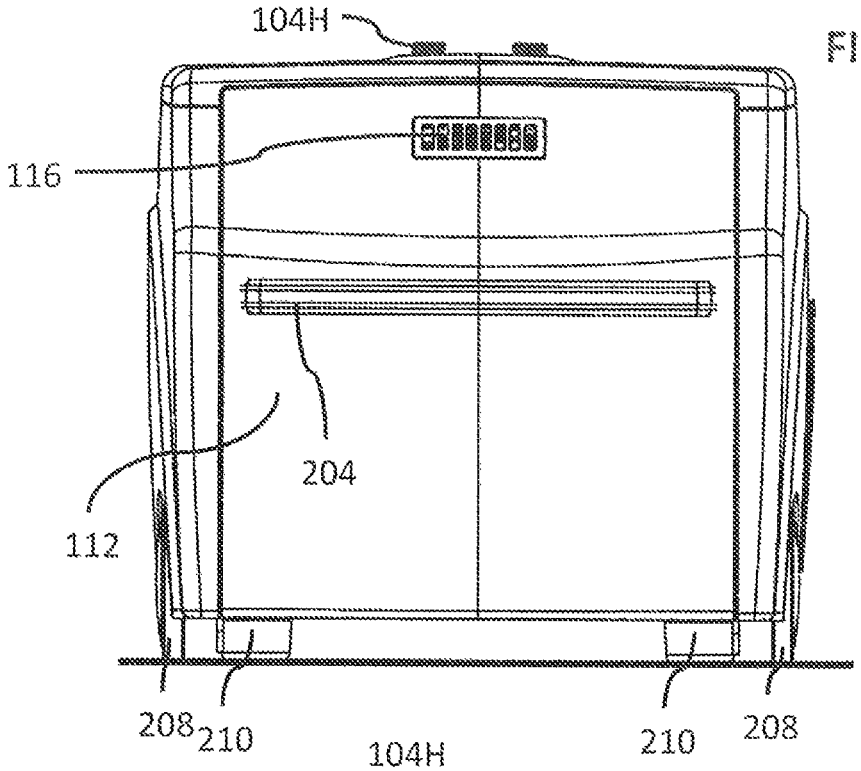
FIG. 6C is an end elevation view of the furniture apparatus of FIG. 6A with compartments in a closed position.
Figure 6D:
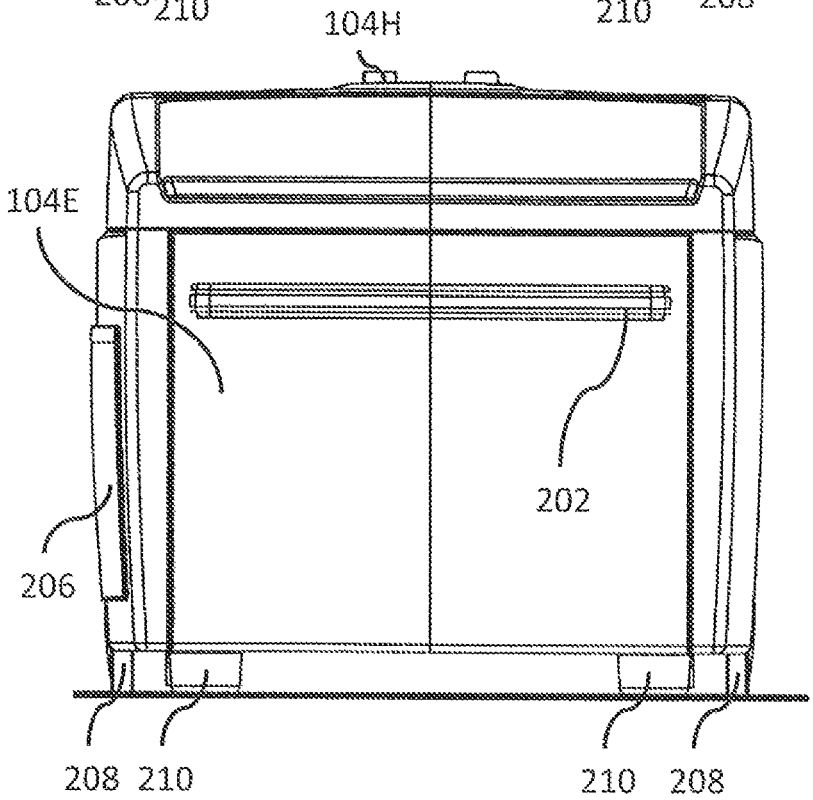
FIG. 6D is another end elevation view of the furniture apparatus of FIG. 6A with compartments in a closed position.

FIGS. 6C and 6D depict the end views of the example of the furniture apparatus 100 in the closed position. The safe assembly 112 is mounted or positioned at one end of the furniture apparatus 100. The compartment 104E is mounted or positioned at another end (an opposite end) of the furniture apparatus 100. The furniture apparatus 100 is depicted at rest with both the wheel assembly 210 and the stand assembly 208 contacting the ground surface or floor. The wheel assembly 210 includes two instances of the wheel assembly 210 that are positioned or located on opposite lateral sides of the furniture apparatus 100. The stand assembly 208 includes two instances of the stand assembly 208 that are located or positioned on opposite lateral sides of the furniture apparatus 100. The wheel assembly 210 and the stand assembly 208 are located at opposite sides of the furniture apparatus 100.

Figures 7C, 7D:
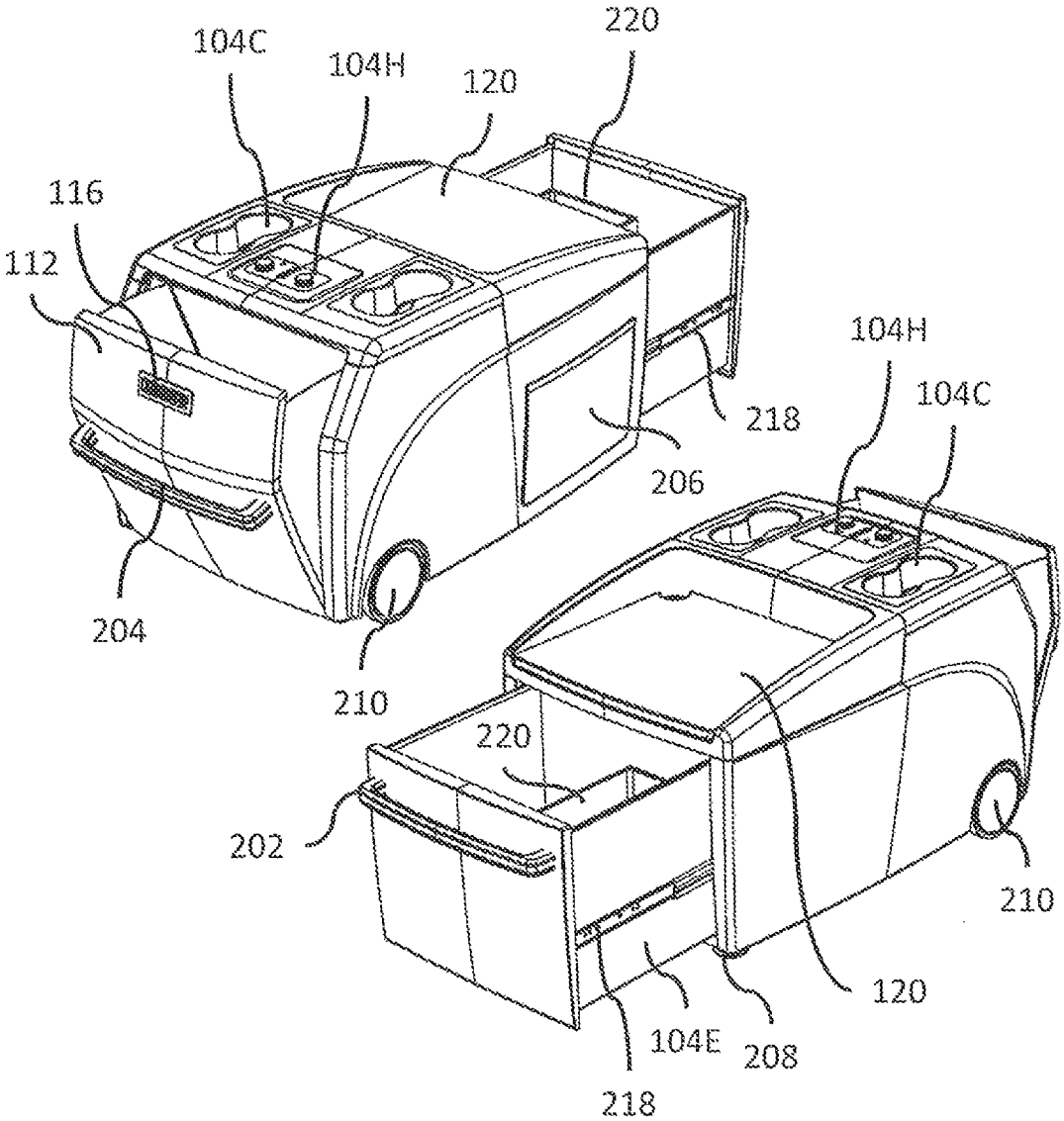
FIG. 7C is an isometric view of the furniture apparatus of FIG. 6A, with compartments in an open position.
FIG. 7D is another isometric view of the furniture apparatus of FIG. 6A, with compartments in an open position.

FIGS. 6E and 6F depict the perspective views of the example of the furniture apparatus 100 in the closed position, in which are depicted a view of the safe assembly 112 and the compartment 104E respectively. Referring now to FIGS. 7A, 7B, 7C, 7D, there are depicted examples of the furniture apparatus 100 in which the user-accessible compartments 104 are all placed in an open position or condition. FIG. 7A depicts the top view of the example of the furniture apparatus 100 in the open position. The safe assembly 112 is placed in an open position or state, in which the contents of the safe assembly 112 may be accessible to the user. The compartment 104E is placed in an open position or state in which the contents of the compartment 104E may be accessible to the user. The compartment 104E includes a tray assembly 220 configured to receive items.

FIG. 7B depicts the side view of the example of the furniture apparatus 100 in the open position. According to the option depicted in FIG. 7B, the door of the safe assembly 112 is pivotally movable between the closed position as depicted in FIG. 6B and the open position as depicted in FIG. 7B. According to another option as depicted in FIG. 7D, the door of the safe assembly 112 is configured to open in the same way as a conventional door. The compartment 104E is linearly movable between the closed position as depicted in FIG. 6B and the open position as depicted in FIG. 7B. It will be appreciated that the doors of the user-accessible compartments 104 of the furniture apparatus 100 may be opened in any manner, such as pivotally, linearly, etc.

FIGS. 7C and 7D depict the perspective views of the example of the furniture apparatus 100 in the open position. A slide hardware mechanism 218 is mounted to opposite sides of the compartment 104E. The slide hardware mechanism 218 is configured to permit linear sliding movement of the compartment 104E.

Figure 8:
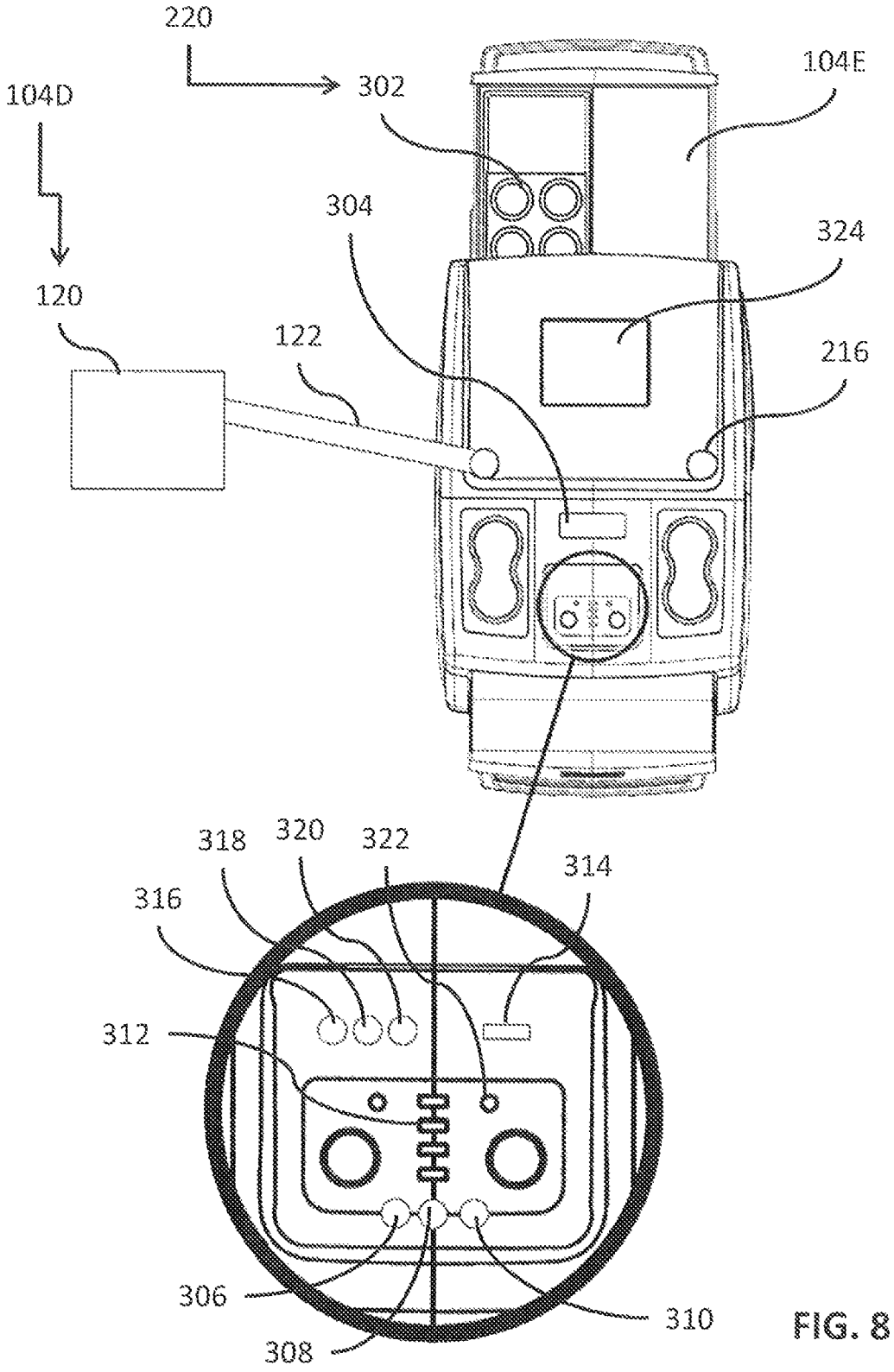
FIG. 8 is a top view of a furniture apparatus according to an embodiment with a portion enlarged.

FIG. 8 depicts a top view of the example of the furniture apparatus 100. The compartment 104D includes the user surface 120 that is configured to provide a swivel tablet tray that may be configured to support a touch-screen interface. The compartment 104E is configured to accommodate or to receive an optional passive-cooling assembly or an active-refrigeration assembly each of which are configured to provide a cold storage area or cavity. The provision 216 is configured to provide a mounting location for an expandable tray that may be configured to swivel, and may interface with a variety of electronic devices. The tray assembly 220 is configured to accommodate and to present a boutique assembly 302. The boutique assembly 302 is configured to present products to be selected by the user. The boutique assembly 302 includes a sensor assembly configured to monitor product usage. As well, the boutique assembly 302 is also configured to charge for product used to a credit card, debit card, room tab, etc.

The furniture apparatus 100 may further include an outer panel assembly that is configured to accommodate any one of: a communication assembly 304 (such as a telephone, a cell phone, an intercom, etc.), an emergency button assembly 306, a call button assembly 308, a reserved indicator 310, a charging station 312, a hand-held docking station 314, a pre-loaded music player 316, a satellite radio 318, an integrated speaker system 320, a headphone jack 322 (configured to facilitate private listening of audio signals for the user), and/or a touch-screen interface 324. The touch-screen interface 324 is configured to facilitate internet access, provide access to electronic entertainment (games, videos, etc.), places, reservations, order food service, and/or function as a virtual concierge service. The reserved indicator 310 is configured to provide an indication that the furniture apparatus 100 is currently reserved for a selected user. The charging station 312 is configured to facilitate recharging of an electronic device, such as a laptop, cell phone, etc. The hand-held docking station 314 is configured to facilitate connection of an electronic device, such as a music player device, to the headphone jack 322, or to connect the electronic device to other facilities such as an internet network connection, etc.

Generally speaking, in view of the foregoing description, in accordance with a general option, an apparatus is provided (examples of which are depicted in the Figures), in which the apparatus includes (and is not limited to): a storage assembly having user-accessible compartments being arranged relative to each other, of which are categorized by different types of user access.

It may be appreciated that the assemblies and modules described above may be connected with each other as may be required to perform desired functions and tasks that are within the scope of persons of skill in the art to make such combinations and permutations without having to describe each and every one of them in explicit terms. There is no particular assembly, components, or software code that is superior to any of the equivalents available to the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) description provided outside of this document (that is, outside of the instant application as filed, as prosecuted, and/or as granted). It is understood, for the purposes of this document, the phrase "includes (and is not limited to)" is equivalent to the word "comprising." It is noted that the foregoing has outlined the non-limiting embodiments (examples). The description is made for particular non-limiting embodiments (examples). It is understood that the non-limiting embodiments are merely illustrative as examples.

Although embodiments have been described with reference to the drawings, those of skill in the art will appreciate that variations and modifications may be made without departing from the spirit and scope thereof as defined by the appended claims.

What is claimed is:

1. A furniture apparatus comprising:

an outdoor-storage assembly having:

user-accessible compartments being arranged relative to each other the user-accessible compartments including:

a cup holder;

a secured user-accessible compartment configured to electronically permit authorized user access while preventing unauthorized user access;

an unsecured user-accessible compartment configured to permit unrestricted user access;

a recharging station electrically coupled to one or more solar cells, the recharging station configured to recharge a battery of an electronic device; and a transaction-swipe device configured to identify items removed from a compartment of the furniture apparatus by a user, and to account for the removed item for invoicing upon checkout by the user.

2. The furniture apparatus of claim 1, wherein the user-accessible compartments include:

a compartment having a table assembly.

3. The furniture apparatus of claim 1, further comprising:

a frame assembly supporting the user-accessible compartments, and the frame assembly also supporting an outer-panel assembly.

4. The furniture apparatus of claim 1, wherein the user-accessible compartments include:

a compartment having a safe assembly being configured to secure objects against unauthorized user access.

5. The furniture apparatus of claim 1, wherein the user-accessible compartments include:

a compartment having a cooling assembly being configured to keep items cool.

6. The furniture apparatus of claim 1, wherein the user-accessible compartments include:

a compartment having a service-request assembly configured to request for service.

7. The furniture apparatus of claim 1, wherein the user-accessible compartments include:

a compartment having a boutique assembly being configured to present items for sale.

8. The furniture apparatus of claim 1, wherein the user-accessible compartments include:

a compartment having a communications device configured to facilitate user communication.

9. The furniture apparatus of claim 1, wherein the user-accessible compartments include:

a compartment having an entertainment unit.

10. The furniture apparatus of claim 1, wherein the user-accessible compartments include:

a compartment having a financial-transaction device.

11. The furniture apparatus of claim 1, wherein the user-accessible compartments include:

a compartment having an alarm assembly configured to provide an indication of unauthorized movement of at least one compartment of the user-accessible compartments.

12. The furniture apparatus of claim 1, further comprising:

a frame assembly being stackable, and the frame assembly supporting the user-accessible compartments.

13. The furniture apparatus of claim 1, wherein the user-accessible compartments include:

a compartment having a magazine-rack assembly.

14. The furniture apparatus of claim 1, wherein the user-accessible compartments include:

a compartment having a tracking device configured to broadcast a position of the furniture apparatus.

15. The furniture apparatus of claim 1, further comprising:

an outer-panel assembly; and a frame assembly supporting the user-accessible compartments, and the frame assembly also supporting the outer-panel assembly, wherein:

the user-accessible compartments include compartments having:

a security-connection assembly being configured to tether the outdoor-storage assembly, a user surface, a cooling assembly being configured to cool an item, a service-request assembly configured to request for service, a display assembly configured to display information, a boutique assembly being configured to present items for sale, a communications device configured to facilitate user communication, an entertainment unit, a financial-transaction device, an alarm assembly configured to provide an indication of unauthorized movement of at least one compartment of the user accessible compartments, and a tracking device configured to broadcast a position of the furniture apparatus.

16. The furniture apparatus of claim 1, wherein the user-accessible compartments include:

a bio-identification device configured to authenticate user access to the furniture apparatus.

17. The furniture apparatus of claim 1, wherein the user-accessible compartments include:

a status-indicator device configured to show an availability status of the furniture apparatus.

18. The furniture apparatus of claim 1, wherein the user-accessible compartments include:

a social-networking device configured to facilitate social networking for the user.

19. The furniture apparatus of claim 1, wherein the user-accessible compartments include:

a reservation device configured to indicate when a restaurant table is ready for use by the user.

20. A furniture apparatus comprising:

an outdoor-storage assembly having:

user-accessible compartments being arranged relative to each other the user-accessible compartments including:

a cup holder;

a secured user-accessible compartment configured to electronically permit authorized user access while preventing unauthorized user access;

an unsecured user-accessible compartment configured to permit unrestricted user access;

a recharging station electrically coupled to one or more solar cells, the recharging station configured to recharge a battery of an electronic device; and a reservation device configured to indicate when a restaurant table is ready for use by the user.

* * * * *